US006824179B1

(12) United States Patent
Shelato

(10) Patent No.: US 6,824,179 B1
(45) Date of Patent: Nov. 30, 2004

(54) GOLF BALL PICK UP DEVICE

(76) Inventor: Robert F Shelato, 7171 Reymoor Dr., N. Fort Myers, FL (US) 33917

( * ) Notice: Subject to any disclaimer, the term of this patent is extended or adjusted under 35 U.S.C. 154(b) by 129 days.

(21) Appl. No.: 09/917,988

(22) Filed: Jul. 30, 2001

(51) Int. Cl.[7] ..... A63B 47/02; A63B 57/00
(52) U.S. Cl. ..... 294/19.2; 473/286; 473/386
(58) Field of Search ..... 294/19.1, 19.2, 294/99.1, 22; 56/332, 334, 336, 339; 221/283, 285; D21/721, 789, 793; 473/284, 286, 386

(56) References Cited

U.S. PATENT DOCUMENTS

| | | | | | |
|---|---|---|---|---|---|
| 2,810,252 | A | * | 10/1957 | Kelly | 294/19.2 |
| 2,814,520 | A | * | 11/1957 | Ruhland | 294/19.2 |
| 3,136,573 | A | * | 6/1964 | Harke | 294/19.2 |
| 3,258,286 | A | * | 6/1966 | Coward | 294/19.2 |
| 4,013,295 | A | * | 3/1977 | Baughman | 294/19.2 |
| 4,063,769 | A | * | 12/1977 | Zimmer | 294/19.2 |
| 4,596,413 | A | * | 6/1986 | La Porte | 294/19.2 |
| 4,659,125 | A | * | 4/1987 | Chuan | 294/19.2 |
| 4,719,826 | A | * | 1/1988 | DuBois | 294/19.1 |
| 4,964,665 | A | * | 10/1990 | Crow | 294/19.2 |
| 5,265,926 | A | * | 11/1993 | DiNardo | 294/19.2 |
| 5,335,953 | A | * | 8/1994 | Luther, Sr. | 294/19.2 |
| 5,787,698 | A | * | 8/1998 | Rushing | 56/332 |

FOREIGN PATENT DOCUMENTS

| | | | | |
|---|---|---|---|---|
| GB | 412707 | * | 7/1934 | 294/19.2 |

* cited by examiner

*Primary Examiner*—Paul T. Chin

(57) ABSTRACT

Golf ball pick up devices are disclosed which are simple in design and construction while permitting exceptional performance during usage. The golf ball pick up device will have an elongated handle with a tubular housing positioned at one end thereof and a tension member extending across the lower opening of the tubular housing. The tension member will have a displacement resistance which permits passage of a golf ball thereby and into a cavity of the tubular housing when the device is placed over the golf ball and which prevents passage of the golf ball thereby during subsequent manipulation of the device. Numerous optional features are explained including devices to set a tee, pick up a tee, place a golf ball, mark a golf balls location and pick up a golf ball marker.

9 Claims, 13 Drawing Sheets

FIG. 4
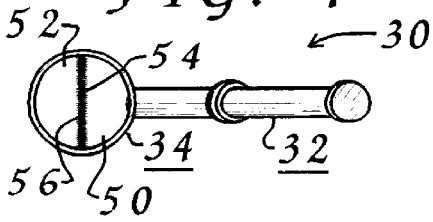
FIG. 5
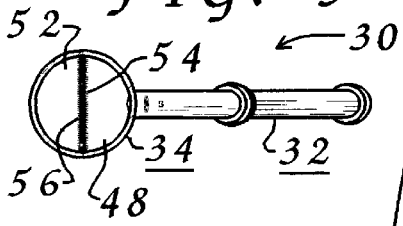
FIG. 6
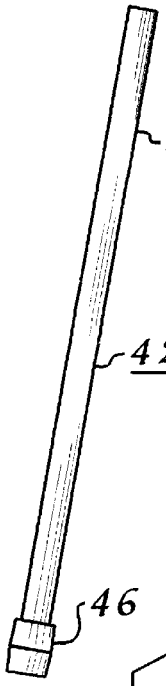
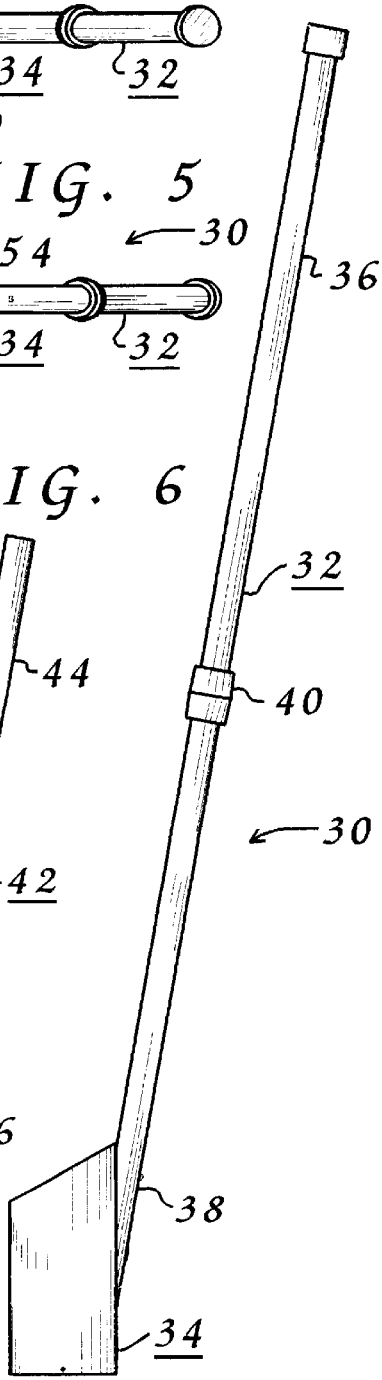
FIG. 1
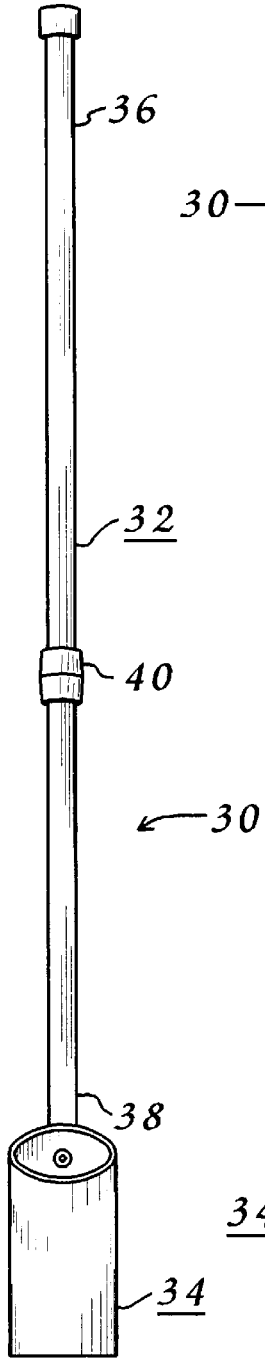
FIG. 2
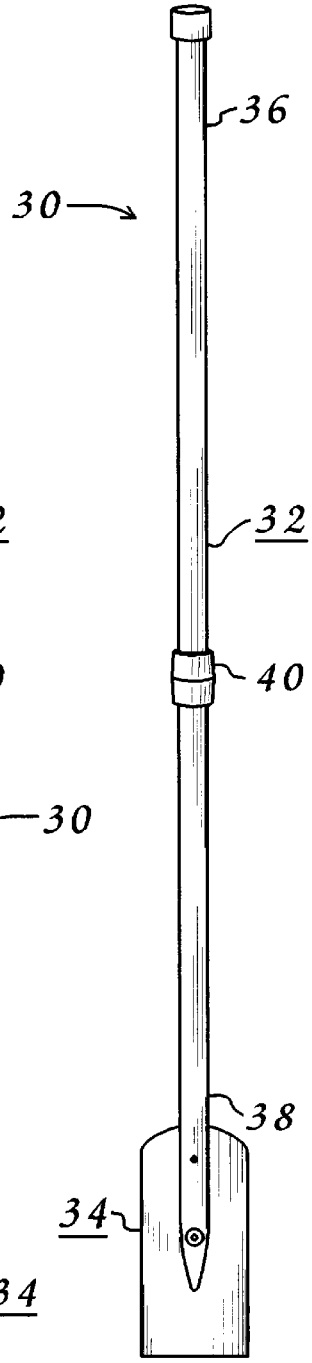
FIG. 3

64
66
34
74
34
64
66

72
70
70
64
68
70
34

80
84
76
82
84
84
78

GOLF BALL PICK UP DEVICE

BACKGROUND

1. Field of the Invention

Generally, the invention relates to devices which allow a person to pick up an object from a resting place without requiring the person to bend over or squat down. More specifically, the invention relates to such devices which may be utilized to pick up golf balls.

2. Description of the Prior Art

The playing of golf is an extremely popular activity which millions of people enjoy participating in on a regular basis. Devices having features of the present invention may be employed by golfers of all ages, of all skill levels and of all levels of physical abilities. Such devices are particularly suited to scramble play and play by persons lacking the physical dexterity to comfortably perform all of the required activities associated with bending or squatting which must be repetitively performed during each round of golf. Additionally, use of devices having features of the present invention will allow persons currently hesitant or even unwilling to participate in golf due to physical limitations to participate and enjoy golf by eliminating the requirement of repetitive bending over or squatting down during play.

Scramble play typically involves two or four players with each player making a shot from the tee. Subsequent to these shots all of the players make each successive shot from the location of the best played golf ball in the scramble group. Therefore, each of the other golf balls must be picked up from the ground and transported to the location of the best positioned golf ball and repositioned thereat for subsequent play from that location. Typically, scramble players utilize a golf cart with two players riding therein during each round. Even though discouraged by golf course operators, many scramble players will drive their golf cart adjacent to each of the golf balls to be picked up and then lean out of the golf cart and pick up the golf ball from the ground with his or her hand rather than getting out of the golf cart and bending over or squatting down to retrieve the golf ball. This leaning out practice is dangerous and has been known to cause accidents where persons have fallen out of the golf cart including the occurrence of such accidents where serious injury has resulted.

Examples of bending or squatting activities which must be repetitively performed during each round of golf may include installing a tee in the ground, placing a golf ball on the tee, picking up the tee subsequent to striking the golf ball positioned thereon, placing a ball marker at the location of the golf ball on the green, picking up the golf ball adjacent the ball marker, positioning the golf ball adjacent the ball marker, picking up the ball marker subsequent to positioning the golf ball adjacent thereto, removing the golf ball from the hole and retrieving the golf ball from areas where continued play is not advisable.

Often golf shots result in placement of golf balls in locations where the golf ball is visible to the player but where retrieval of the golf ball is inconvenient, dangerous or simply impossible. Examples of such locations include down steep inclines, under heavy low lying branches of trees and in bodies of water. Often golf balls in these situations may be retrieved if the player has access to a retrieval device with sufficient extension capabilities and an engagement device capable of engaging the golf ball. Typically, such long range retrieval devices are specifically designed to act to retrieve golf balls from a long distance and are awkward or inconvenient to use for routine retrieval tasks where the player is standing directly over the golf ball.

Various devices are known in the art to allow for retrieval of golf balls from the ground or from a water hazard. These devices may be employed while the player stands over the golf ball in close proximity to the golf ball or where the player stands a substantial distance from the golf ball. Several of these devices are versatile in that they permit use either at close range or at a substantial distance from the golf ball. Various methods are known in the art to provide for extension of a pick up device from a transport orientation to a deployed orientation where the deployed orientation has a length sufficient to permit a standing user to utilize the pick up device at a relatively great distance from the object being picked up and several of these methods have previously been employed for golf ball retrieval devices. Generally, the devices known in the art for golf ball retrieval are complicated devices which often rely upon a surrounding jaw type engagement of the golf ball during the act of retrieval.

Various devices are known in the art to permit a standing golfer to insert a tee into the ground. Various devices are known in the art to permit a standing golfer to mark a positional location of a golf ball on the ground prior to removal of the golf ball from the ground. Various devices are known in the art to permit a standing golfer to place a golf ball on the ground. Various devices are known in the art to permit a standing golfer to pick up a tee from the ground including those tees lying on the ground and those tees inserted in the ground and standing generally vertical. Generally, the devices to perform the above mentioned peripheral actions during the play of golf are solitary devices which perform a single dedicated function or which perform a pair of closely related functions.

As can be seen, various attempts have been made to provide for manipulation of golf balls and associated golf accessories during the play of golf. These attempts have been less efficient than desired. As such, it may be appreciated that there continues to be a need for a golf ball pick up device which is simple in design, is simple to use and which may function in various situations. The present invention substantially fulfills these needs.

SUMMARY

In view of the foregoing disadvantages inherent in the known types of golf ball pick up devices, your applicant has devised a method of picking up a golf ball from a ground surface and transferring the golf ball to an elevated location for subsequent release. Golf ball pick up devices of the present invention will have an elongated handle, a tubular housing and a tension member. The elongated handle has opposing ends with one of these ends being a gripping end with the opposing end being a distal end. The tubular housing has a first opening, a second opening and a cavity positioned between the first opening and the second opening. The tubular housing is attached to the distal end of the elongated handle with the first opening of the tubular housing positioned away from the gripping end of the elongated handle and the second opening of the tubular housing positioned toward the gripping end of the elongated handle. The tension means provides for a displacement resistance from a static position or natural position. The displacement resistance of the tension means is insufficient to prevent passage thereby of the golf ball into the cavity of the tubular housing through the first opening of the tubular housing of the golf ball pick up device while the first opening of the tubular housing of the golf ball pick up device is positioned over the golf ball while the golf ball rests on the ground surface and a downward pressure is applied to the golf ball pick up device. The displacement resistance of the tension means is sufficient to prevent passage thereby of the golf ball from the cavity of the tubular housing through the first opening of the tubular housing of the golf ball pick up device while the golf ball is positioned within the cavity of the tubular housing.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a golf ball pick up device which may be used to pick up a golf ball from the ground and transfer that golf ball to an elevated location for subsequent release.

Other objects include;

a) to provide for a golf ball pick up device which may pick up multiple golf balls.

b) to provide for a golf ball pick up device which may be conveniently used while the player resides in a sitting position in a golf cart.

c) to provide for a golf ball pick up device which may be used to retrieve golf balls from a submerged position in a body of water.

d) to provide for golf ball pick up device which may be readily converted into an orientation where retrieval of a golf ball may occur while the player is located a significant distance from the golf ball.

e) to provide for a golf ball pick up device which may also be utilized to retain a golf tee during insertion into the ground where the player does not have to bend over or squat down during any portion of the installation of the golf tee into the ground.

f) to provide for a golf ball pick up device which may also be utilized to pick up golf tees from the ground while the golf tee either is lying on the ground or still inserted into the ground where the player does not have to bend over or squat down during any portion of the procedure of picking up the golf tee from the ground.

g) to provide for a golf ball pick up device which may also be utilized to place a ball marker on the ground adjacent a golf ball and prior to removal of the golf ball from the ground where the player does not have to bend over or squat down during any portion of the procedure of placing the ball marker on the ground.

h) to provide for a golf ball pick up device which may also be utilized to pick up a ball marker positioned on the ground subsequent to placement of a golf ball adjacent the ball marker where the player does not have to bend over or squat down during any portion of the procedure to pick up the ball marker from the ground.

i) to provide for a golf ball pick up device which may also be utilized to place a golf ball in a specific location either on the ground or upon a golf tee installed in the ground where the player does not have to bend over or squat down during any portion of the procedure of placing the golf ball on the ground or on the golf tee installed in the ground.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 1 is a side elevational view of a golf ball retrieval and pick up device.

FIG. 2 is a front elevational view of the golf ball retrieval and pick up device shown in FIG. 1.

FIG. 3 is a rear elevational view of the golf ball retrieval and pick up device shown in FIG. 1 and FIG. 2

FIG. 4 is a top plan view of the golf ball retrieval and pick up device shown in FIG. 1 through FIG. 3.

FIG. 5 is a bottom plan view of the golf ball retrieval and pick up device shown in FIG. 1 through FIG. 4.

FIG. 6 is a side elevational view of an extension member for use with the golf ball retrieval and pick up device shown in FIG. 1 through FIG. 5.

DESCRIPTION

Figures 7, 8, 9, 10:
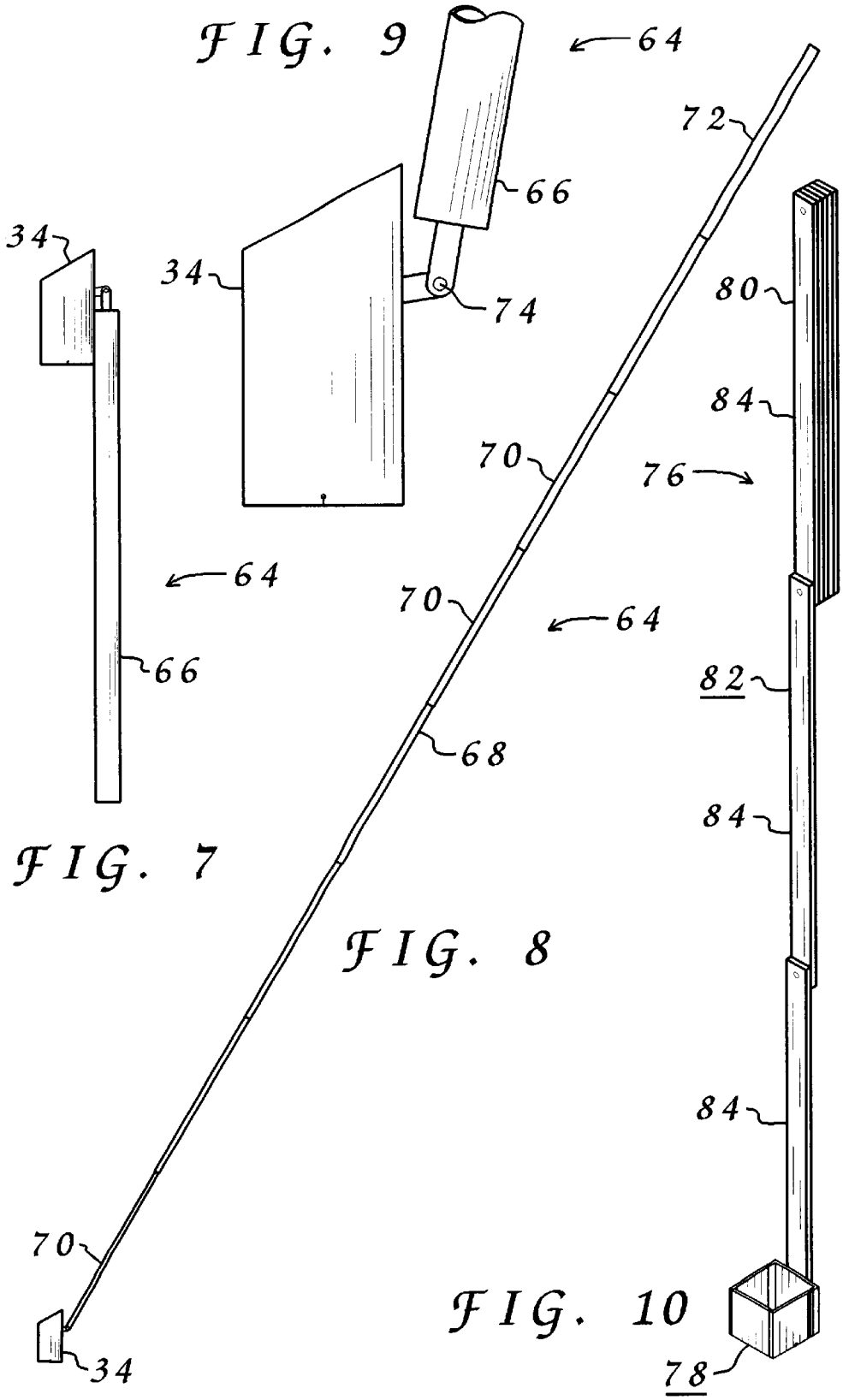
FIG. 7 is a side elevational view of another embodiment of a golf ball retrieval and pick up device and in a retracted orientation.
FIG. 8 is a side elevational view of the golf ball retrieval and pick up device shown in FIG. 7 and in an expanded orientation.
FIG. 9 is an enlarged side elevational view of a portion of the golf ball retrieval and pick up device shown in FIG. 7.
FIG. 10 is a perspective view of yet another embodiment of a golf ball retrieval and pick up device and in a partially expanded orientation.

Many different devices having features of the present invention are possible. The following description describes the preferred embodiment of select features of those devices and various combinations thereof. These features may be deployed in various combinations to arrive at various desired working configurations of devices.

Reference is hereafter made to the drawings where like reference numerals refer to like parts throughout the various views. Devices having features of the present invention may be employed by golfers of all ages, of all skill levels and of all levels of physical abilities. Such devices are particularly suited to scramble play and play by persons lacking the physical dexterity to comfortably perform all of the required activities associated with bending over or squatting down which must be repetitively performed during each round of golf. During scramble play the player, sitting either in the driver's seat or in the passenger's seat, may readily pick up golf balls with a golf ball pick up device having features of the present invention without leaning out of the golf cart. Similarly, a standing player may pick up golf balls from the ground without the need to bend over or squat down. While variations of the device may be designed to pick up only one golf ball preferably the device will enable pick up of at least two golf balls prior to subsequent removal of the golf balls from the device. Due to scramble play often having four players, it is desirable to have the device capable of containing four golf balls. The present invention also may be used to pick up many balls as would be present when practicing various golf shots including putting or chipping and therefore may have the capacity to contain many golf balls as exampled by one or two dozen golf balls or even one hundred or more golf balls.

Ideally, a golf ball pick up device having features of the present invention will be of a construction from suitable materials wherein the device is extremely light and therefore easy for the player to transport and manipulate during use. When various of the optional features are provided it is possible for a player to enjoy a full round of play without requiring the player to bend over or squat down once. Previously, when a player who is unable to repetitively bend over or squat down due to physical limitations or medical reasons wished to play golf it was necessary to have a companion available to perform the procedures which require such activities. The playing of golf will benefit from the present invention by allowing persons previously prohibited for physical reasons from performing those procedures of the playing golf which require bending over or squatting down to now play and enjoy the game of golf.

It is possible to provide for a golf ball pick up device which will fit conveniently on the dash of a golf cart for ready storage during movement of the player about a course. Alternatively, it is possible to provide for a golf ball pick up device which will fit conveniently in a soft drink holder on the golf cart for ready storage during movement of the player about a course. It is also possible to provide means to attach the golf ball pick up device to a golf bag as exampled by a hook which permits the retrieval device to hang on the outside of the golf bag when not being used. Of course, the golf ball pick up device may be configured wherein it may be readily placed into the golf bag along with the golf clubs contained therein and be as easily accessible as the conventional golf clubs. Alternatively, it is possible to provide for a truly transportable golf ball pick up device which folds up for ready transport, as exampled by in a pocket of a golf club bag, and which unfolds for use during a round of golf.

A basic golf ball pick up device having features of the present invention will have an elongated handle for manipulation by the player, a hollow canister attached to the elongated handle to contain golf balls and a tension member across a lower opening of the canister which allows entry of golf balls but which inhibits release of golf balls therepast.

The golf ball pick up device may be rested on the ground and the grip or grips of golf clubs may be rested across the golf ball pick up device to keep the grips of the golf clubs off of the ground to prevent the grips from getting wet or dirty from the grass or ground while the user plays with another golf club. When the golf ball pick up device is rested on the ground the user may retrieve the golf ball pick up device from the ground using another club to manipulate the device without requiring the user to bend over or squat down. The user may similarly manipulate any golf clubs resting on the device to retrieve that club or clubs without requiring the user to bend over or squat down. Alternatively, it is possible to provide for structures on the golf ball pick up device to provide for the golf ball pick up device to stand up unattended while resting on the ground.

FIG. 1 through FIG. 5 depict a golf ball pick up device 30 having an elongated handle 32 and a tubular housing 34 attached to elongated handle 32. Elongated handle 32 has a gripping end 36 and a distal end 38. Tubular housing 34 is attached to distal end 38 of elongated handle 32. In the embodiment depicted in these views elongated handle 32 has an intermediate coupling 40 positioned therein where elongated handle 32 may be selectively separated. FIG. 6 depicts an extension member 42 having a tube 44 and a coupling 46. When elongated handle 32 is separated at intermediate coupling 40 any select number of extension members 42 may be installed therein to provide for expansion of spacing between tubular housing 34 and gripping end 36. Tubular housing 34 has a first opening 48, see FIG. 5, and a second opening 50, see FIG. 4, with a cavity 52 positioned therebetween. A tension member 54 is positioned across first opening 48. In this embodiment tension member 54 is a coil spring and is positioned at a generally central location on first opening 48 although numerous other types of tension members may be employed and numerous other placement locations relative to first opening 48 may be selected. Tension member 54 has a tautness which produces a displacement resistance from a static position 56.

Golf ball pick up devices of the present invention may be employed to pick up golf balls from the ground, when submerged in water and from the hole. In use the canister of the device is positioned over the golf ball to be retrieved where downward pressure is then applied to the golf ball pick up device caused the golf ball to move past the tension member and enter a cavity of the canister. Following this action the golf ball pick up device may be manipulated by the player without undue concern that the golf ball will cause a subsequent displacement of the tension member which would permit the golf ball to escape from the cavity of the canister past the tension member.

Figure 16A:
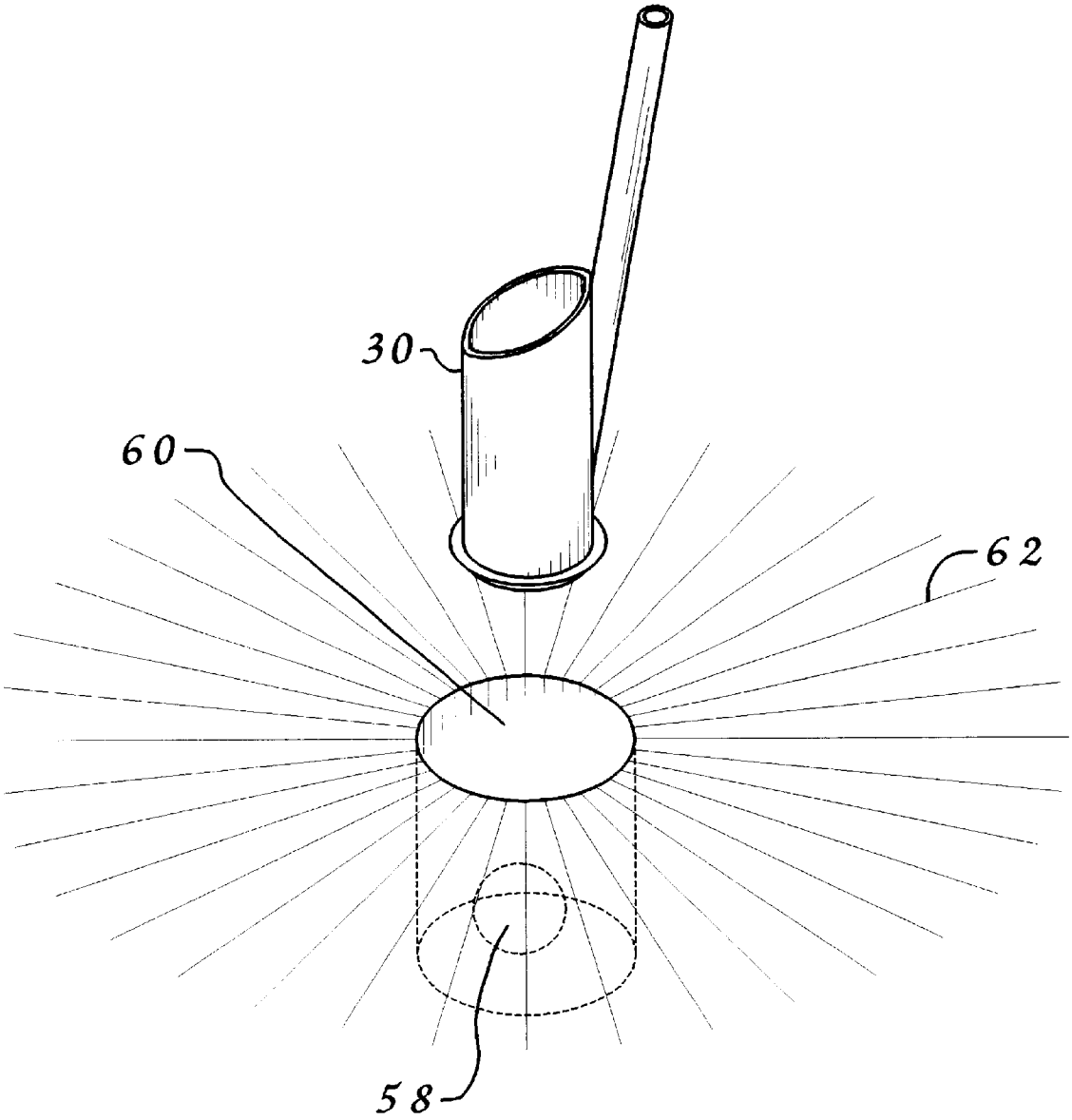
FIG. 16*a* through FIG. 16*c* are perspective views of yet another embodiment of a golf ball retrieval and pick up device in various orientation relative to a hole on a green including hidden images of the interior of the hole and a golf ball.
Figure 16B:
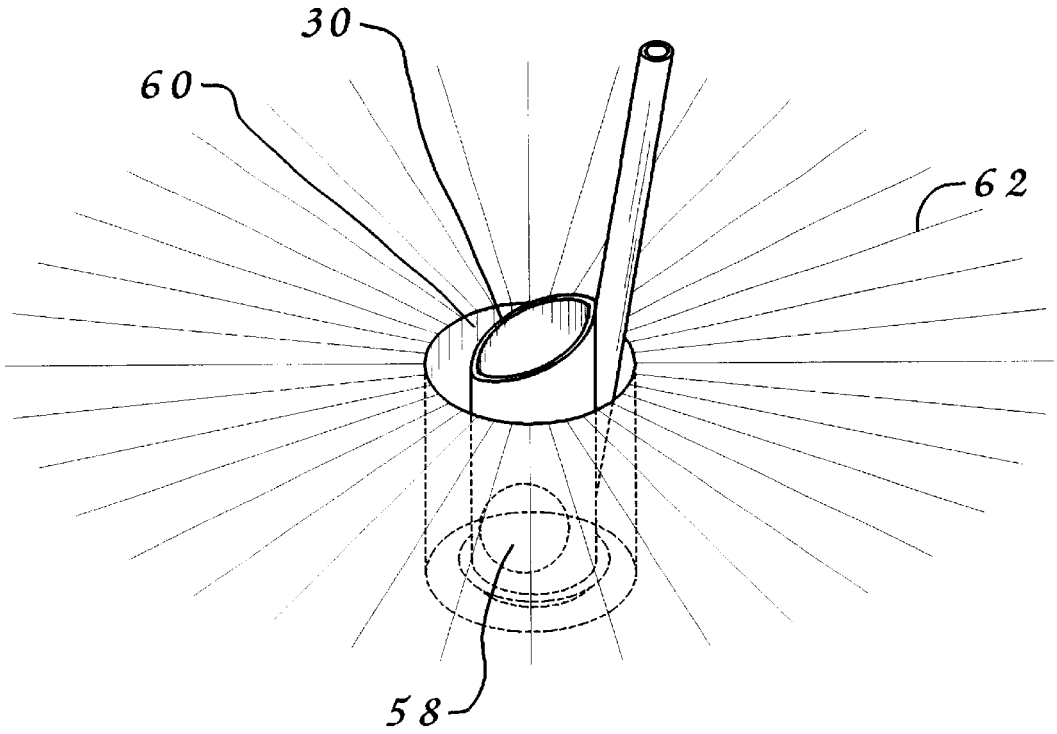
Figure 16C:
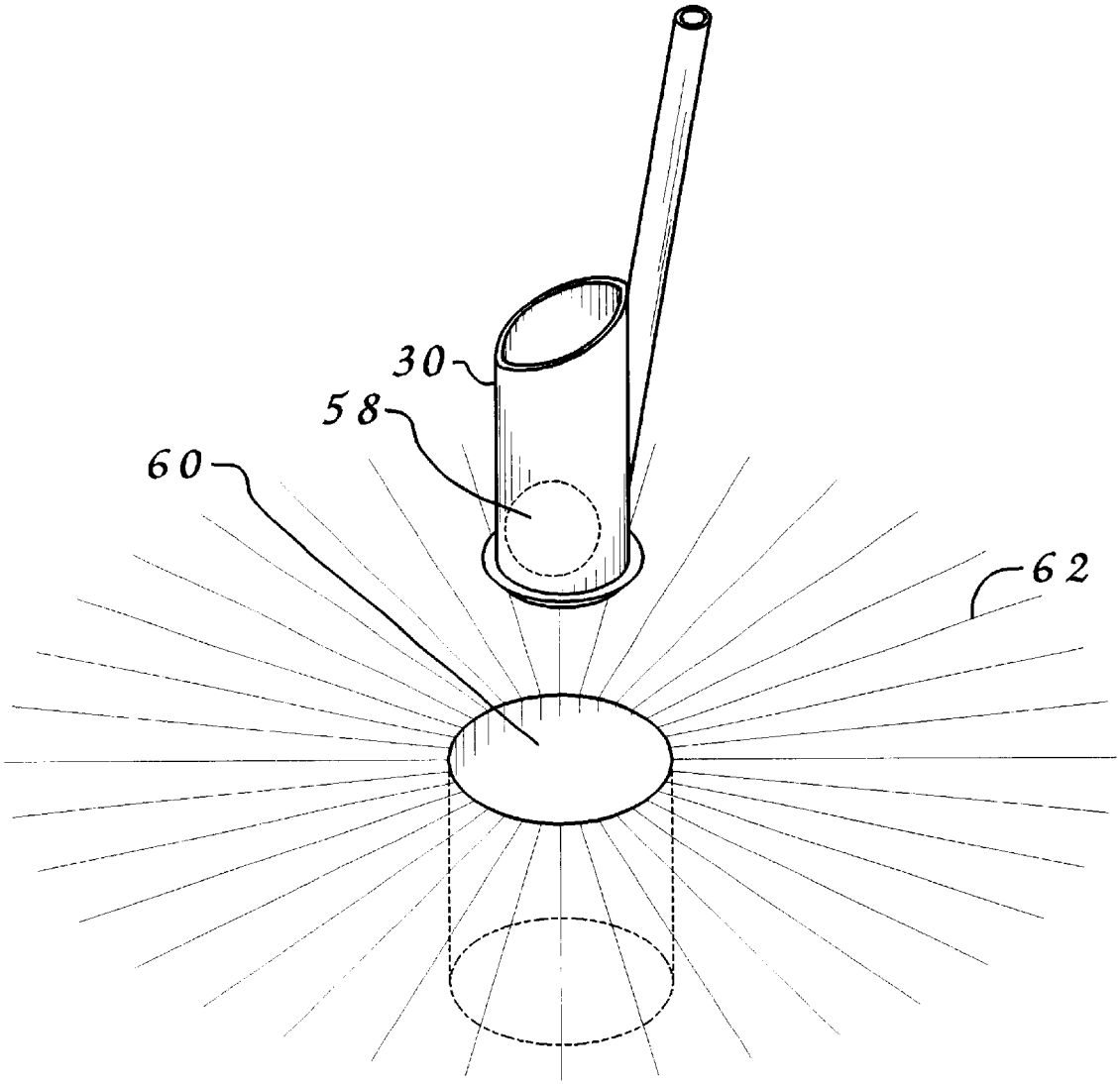

Reference is now made to FIG. 4, FIG. 5 and FIG. 16*a* through FIG. 16*c*. FIG. 16*a* through FIG. 16*c* depict use of golf ball pick up device 30 during retrieval of a golf ball 58 from a hole 60 positioned in a ground 62. A similar procedure is employed when golf ball 58 is positioned on ground 62. First golf ball pick up device 30 is positioned over golf ball 58, see FIG. 16*a*. Then, golf ball pick up device 30 is pushed downward over golf ball 58 wherein a downward pressure is applied between golf ball pick up device 30 and golf ball 58 wherein golf ball 58 moves past tension member 54 and into cavity 52 of tubular housing 34, see FIG. 16*b*. Then golf ball pick up device 30 is elevated to a convenient elevational location where the user, not shown in any of the various views, may remove golf ball 58 from golf ball pick up device 30. The displacement resistance of tension member 54 is sufficient to prevent passage thereby of a golf ball or golf balls from cavity 52 through first opening 48 in the absence of an externally applied force. The displacement resistance of tension member 54 is insufficient to prevent passage thereby of a golf ball through first opening 48 and into cavity 52 when golf ball pick up device 30 is placed over the golf ball and the downward pressure is applied to golf ball pick up device 30.

Preferably, golf ball pick up devices having features of the present invention will have the capability of retrieving golf balls from placement locations where the player is prevented from positioning his or her self in close proximity thereto. This is easily accomplished by providing for extension of the hollow canister a significant distance from the player manipulation end of the elongated handle. This may be accomplished by either having additional extension members which may be attached to the golf ball pick up device or providing the elongated handle with expansion capabilities. The expansion capability for the elongated handle include a telescoping design are a fold up design. When a telescoping design is employed it is possible to provide for containment of the telescoping portions within a hollow tubular handle.

As previously disclosed FIG. 6 depicts extension member 42 which may be inserted into elongated handle 32 of golf ball pick up device 30 to provide for extension of tubular housing 34 for retrieval of golf balls from an extended position.

FIG. 7, FIG. 8 and FIG. 9 depict a golf ball pick up device 64 which may be converted between a retracted orientation 66, shown in FIG. 7 and FIG. 9, and an extended orientation 68, see FIG. 8. In this embodiment various portions 70, see FIG. 8, extend in and out relative to a handle 72 to provide for extension of tubular housing 34. If desired a pivotal coupling 74, see FIG. 9, may be utilized to provide for angular adjustment of tubular housing 34 relative to handle 72 or portions 70 to provide for convenient manipulation of golf ball pick up device 64 in may situations.

FIG. 10 depicts a golf ball pick up device 76 capable of extension of a cannister 78 relative to a gripping end 80 of a foldable handle 82. In this embodiment portions 84 of golf ball pick up device 76 are pivotally attached together and may be manipulated by rotation therebetween to provide for the desired expansion and retraction of golf ball pick up device 76.

It may be desirable to provide for compaction of the golf ball pick up device for convenient transport or storage. This may be accomplished by providing for the device to be disassembled or folded up.

Figure 11A:
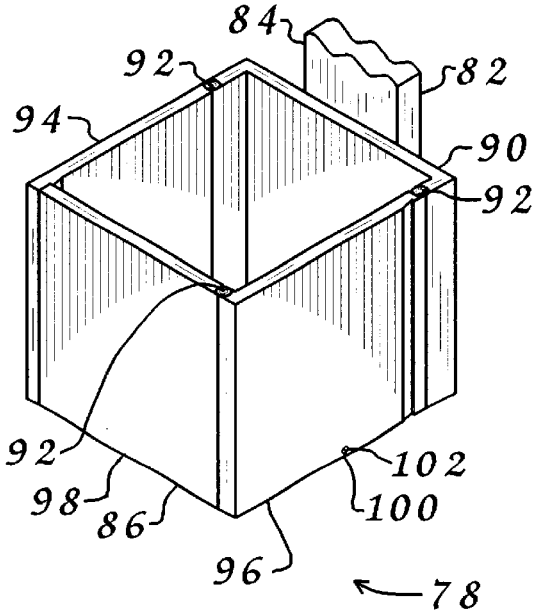
FIG. 11*a* through FIG. 11*d* are enlarged perspective views of a portion of the golf ball retrieval and pick up device shown in FIG. 10 and in various stages of deployment.
Figure 11B:
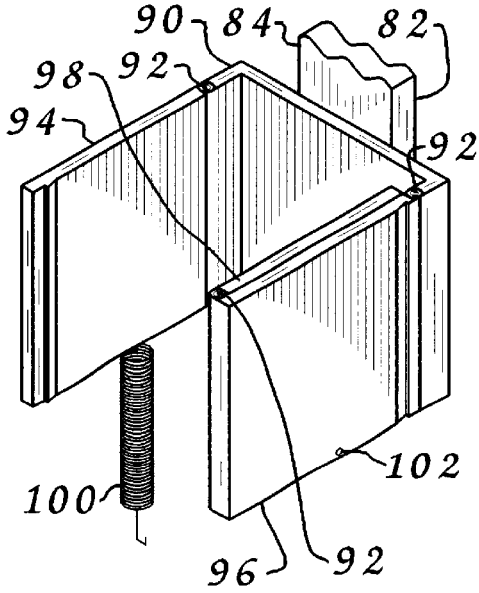
Figure 11C:
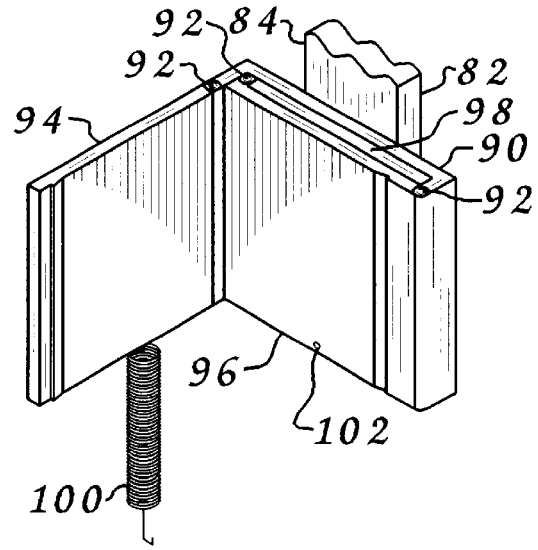
Figure 11D:
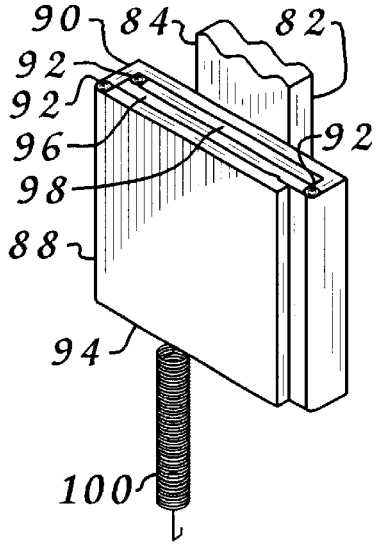

FIG. 11*a* through FIG. 11*d* depict cannister 78 which is convertible between a usage orientation 86, see FIG. 11*a*, and a compact orientation 88, see FIG. 11*d*. Cannister 78 fulfills the same objectives as tubular housing 34 shown in FIG. 1 through FIG. 5 and FIG. 16*a* through FIG. 16*c*. Cannister 78 has a stationary member 90 which is attached to portion 84 of foldable handle 82, see FIG. 10. Pivotally attached to stationary member 90 utilizing a biased hinge 92 is an outer member 94. As conventionally known in the art biased hinge 92 has a tension member thereabout which provides tension in a select direction. Pivotally attached to stationary member 90 utilizing another biased hinge 92 is an intermediate member 96. Pivotally attached to intermediate member 96 utilizing another biased hinge 92 is an inner member 98. Attached to outer member 94 is a tension member 100. A mount 102 is positioned in intermediate member 96 which selectively has tension member 100 attached thereto. While in usage orientation 86 the various biased hinges 92 provide for retaining tension between outer member 94 and inner member 98 which is further reenforced by tension member 100. When transferring cannister 78 from usage orientation 86 to compact orientation 88 tension member 100 is released from mount 102 and inner member 98 is allowed to fold inward against intermediate member 96, see FIG. 11*b*. Following this procedure intermediate member 96 and inner member 98 are allowed to fold inward against stationary member 90, see FIG. 11*c*. Following this procedure outer member 94 is allowed to fold inward against intermediate member 96, see FIG. 11*d*. When transferring cannister 78 from compact orientation 88 to usage orientation 86 the opposite sequence is utilized.

While it is possible to provide a golf ball pick up device which will hold a single golf ball it is preferable to provide for retrieval and retention of multiple golf balls in the golf ball pick up device prior to removal of the golf balls from the device. For scramble play, it is desirable to provide for the retrieval and retention of either two (2) or four (4) golf balls. When practicing various golf shots such as putting or chipping, it is desirable to provide for retrieval and retention of a significant number of golf balls such as ten (10) or twenty (20) or an even division of a dozen, twelve (12) or twenty four (24). When gathering golf balls previously used for practice by multiple players, it is desirable to retrieve and gather in a convenient location, whether within the device or in a separate container, a large number of golf balls such as one hundred (100) or more.

Figure 12:
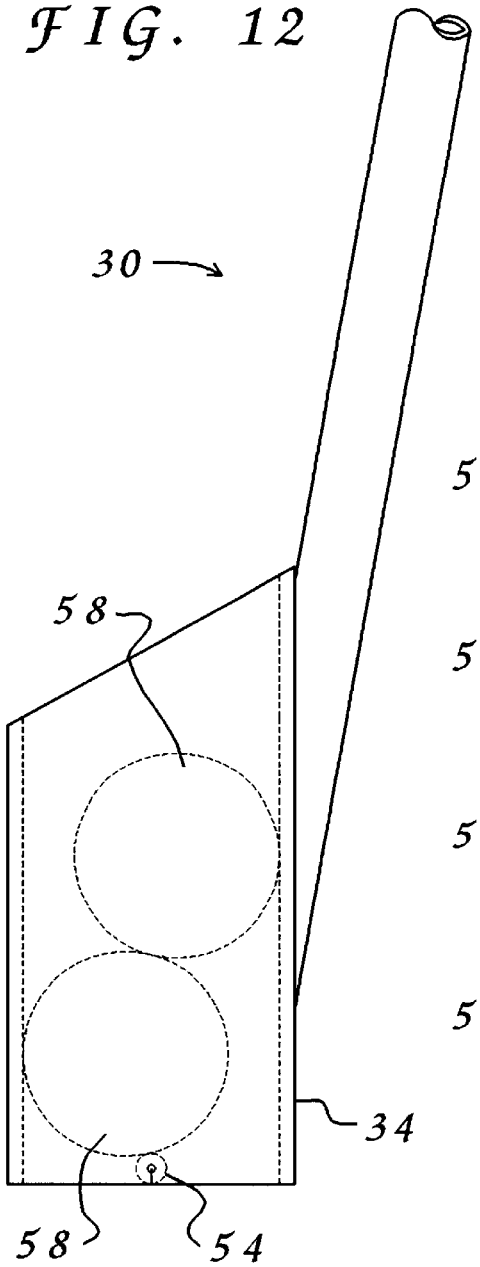
FIG. 12 is a side elevational view of a portion of the golf ball retrieval and pick up device shown in FIG. 1 through FIG. 5 including hidden images of golf balls contained in a cannister thereof.
Figure 13:
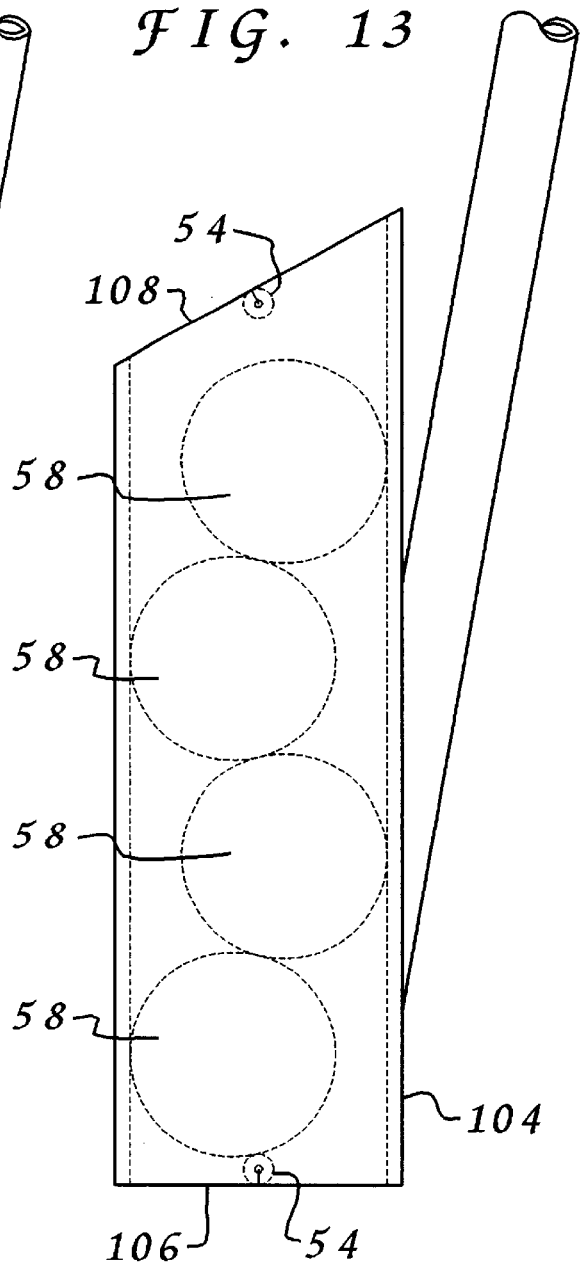
FIG. 13 is a side elevational view of a portion of still another embodiment of a golf ball retrieval and pick up device including hidden images of golf balls contained in a cannister thereof.

FIG. 11*a* depicts canister 78 capable of retrieval and retention of one (1) golf ball, not shown in this view. FIG. 12 depicts tubular housing 34 capable of retrieval and retention of two (2) golf balls 58 utilizing tension member 54. FIG. 13 depicts a tubular housing 104 capable of retrieval and retention of four (4) golf balls 58 utilizing tension member 54 positioned at a lower extent 106 and tension member 54 positioned at an upper extent 108. This dual confinement arrangement provides for retrieval of multiple golf balls 58 with intermediate placement of the golf ball pick up device between usage to pick up each successive golf ball without undue concern for escape of the golf balls from the device. When desired the user would simply displace a select tension member 54 using a finger and allow the golf balls to be released by gravity.

Figure 14:
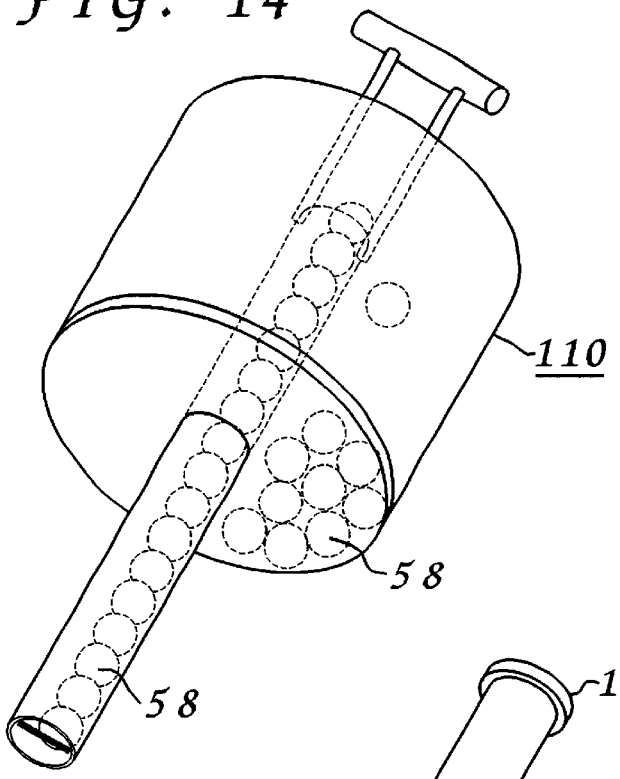
FIG. 14 is a perspective view of yet another embodiment of a golf ball retrieval and pick up device capable of picking up and containing a plurality of golf balls.

FIG. 14 depicts a golf ball pick up device 110 capable of gathering a large quantity of golf balls 58, such as one hundred (100). It is possible to provide for the golf balls to be fed through a flexible hose to a containment vessel if desired to provide for the collection of a very large quantity of golf balls, if desired.

Figure 15A:
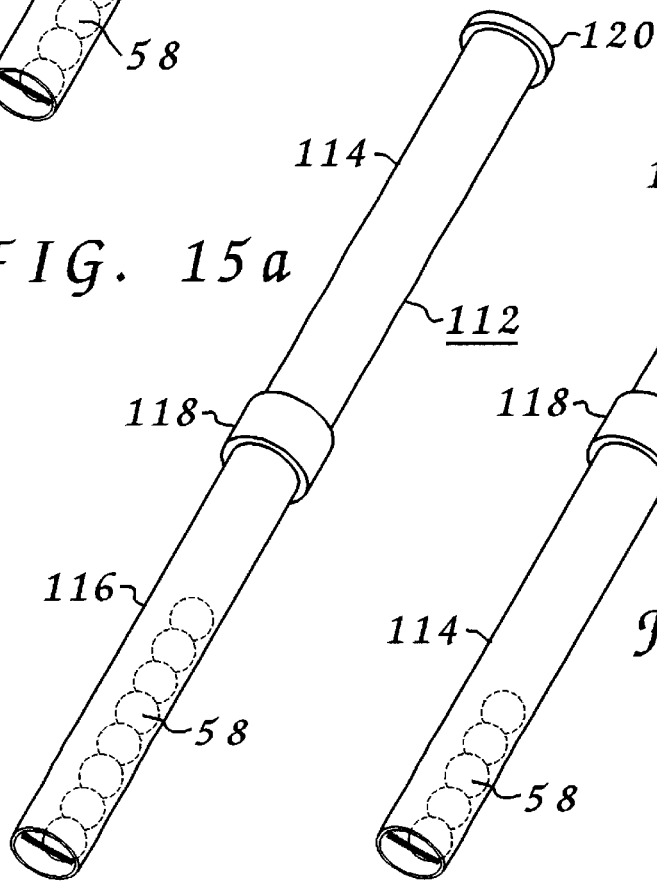
FIG. 15*a* and FIG. 15*b* are perspective views of still another embodiment of a golf ball retrieval and pick up device capable of picking up and containing a plurality of golf balls.
Figure 15B:
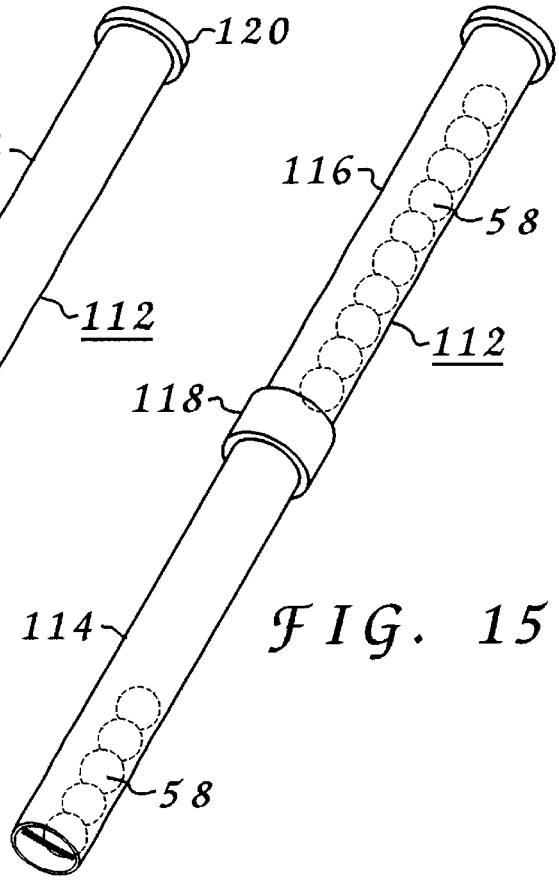

FIG. 15*a* and FIG. 15*b* depict a golf ball pick up device 112 capable of picking up a large number of golf balls 58, such as twenty four (24). In this embodiment a first tubular housing 114 and a second tubular housing 116 are positioned on opposing sides of a separator 118. Each tubular housing 114 and 116 may be removed from separator 118 for unimpeded access to the interior of the respective tubular housing 114 and 116. Separator 118 prevents passage of golf balls between tubular housings 114 and 116. Each tubular housing 114 and 116 has tension member 54 positioned distal from separator 118. In usage the user would pick up golf balls 58 using one end of golf ball pick up device 112 then rotate golf ball pick up device 112 and continue to pick up additional golf balls 58 using the opposing end of golf ball pick up device 112. End caps 120 may be positioned to close either tubular housing 114 or 116 or both for transport or storage of golf balls 58 contained within golf ball pick up device 112. If desired a sling may be attached to golf ball pick up device to permit ready transport of the device.

Each golf ball pick up device having features of the present invention will at least have the ability to retrieve golf balls from the ground without requiring the player manipulating the device to bend over or squat down. Each such device may have structures which allow the player to perform some other operation associated with the play of golf which typically requires the unassisted player to bend over or squat down. The following describes an embodiment of select of those structures to perform specific examples of those associated golfing operations. The structures required to perform each of these respective operations may be permanently attached to the golf ball pick up device or may be a separate component which attaches to the golf ball pick up device during specific occasions. Many methods are conventionally known in the art to provide for a temporary attachment of a detached component to a structural assembly. When it is desired to have a separate component for temporary attachment to the golf ball pick up device of the present invention to perform a desired golfing operation many of these known temporary attachment methods may be employed. Examples of such other operations associated with the play of golf include setting a tee in the ground, picking up the tee subsequent to use, placing a golf ball on the ground or on a tee and placing a ball marker on the ground and subsequently retrieving that ball marker from the ground.

It is desirable to provide for structures to allow for the player to insert a tee into the ground at a desired location while the player remains upright during the entire procedure without requiring the player to bend over or squat down. Such structures must allow the player to position the tee on the device while manipulating the device and the tee at a convenient elevational level, must retain the tee both during movement of the tee to the ground level and during actual insertion of the tee into the ground while the player remains erect during the entire tee setting procedure. Various configurations are possible to provide for these structures.

Figure 17:
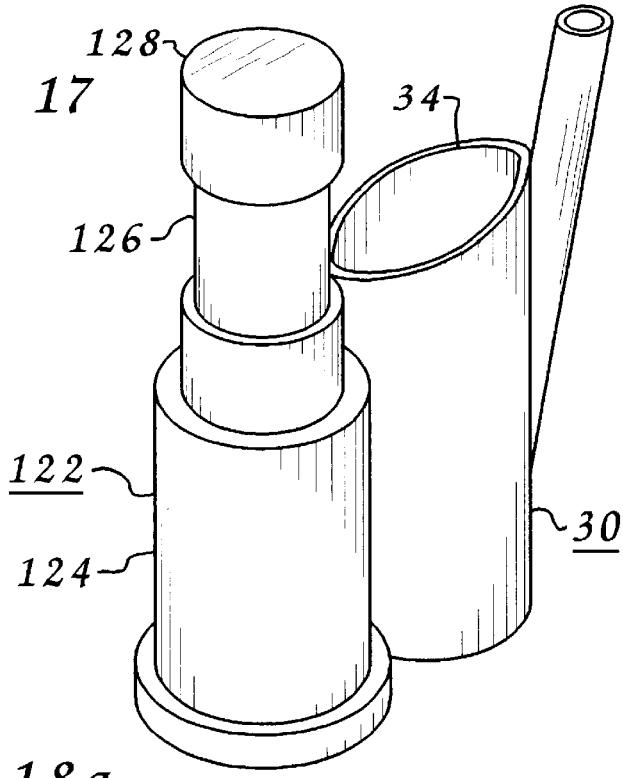
FIG. 17 is a perspective view of a tee setting device attached to the golf ball retrieval and pick up device shown in FIG. 1 through FIG. 5.
Figure 18A:
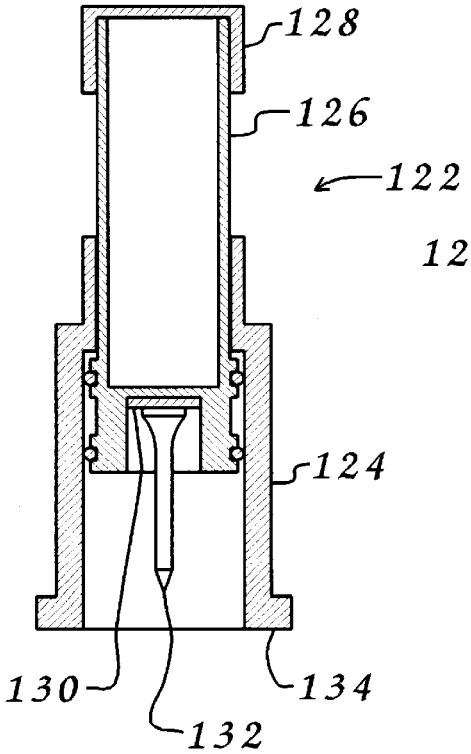
FIG. 18*a* and FIG. 18*b* are sectional views of the tee setting device shown in FIG. 17 and in opposing operational orientations.
Figure 18B:
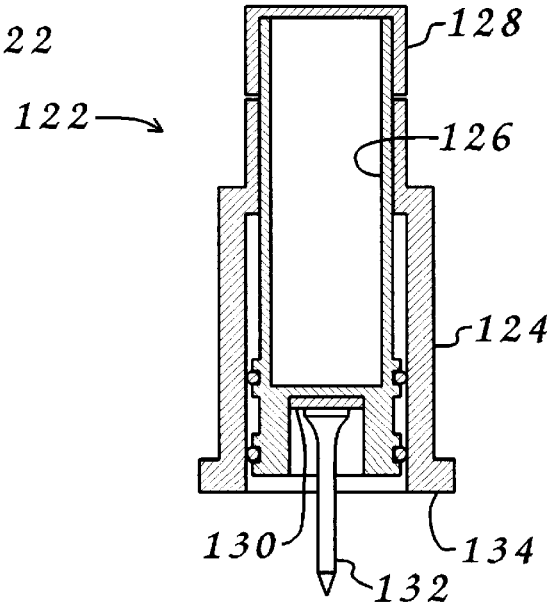

FIG. 17, FIG. 18*a* and FIG. 18*b* depict a tee setter 122 capable of being attached to golf ball pick up device 30 utilizing any connection method conventionally known in the art. It is also possible to provide for the tee setter to be temporarily inserted into the tubular housing during use of the tee setter. In the embodiment depicted tee setter 122 is attached to golf ball pick up device 30 to be positioned in front of tubular housing 34. This arrangement provides for the combination to stand unattended on the ground. As shown in FIG. 18*a* and FIG. 18*b* tee setter 122 has a base 124, a plunger 126 and a cap 128. Plunger 126 has an adhesive material 130 positioned thereon which the user would place a tee 132 against. Adhesive material 130 would retain tee 132 relative to tee setter 122 during the installation procedure of tee 132 into the ground. Preferably, tee 132 is positioned on adhesive material 130 while plunger 126 is fully extended into base 124, see FIG. 18*b*. This allows for ready access to adhesive material 130 during placement of tee 132 there against. Prior to beginning the installation of tee 132 into the ground plunger 126 is retracted relative to base 124 where tee 132 is entirely contained within base 124. Following placement of tee 132 on adhesive material 130 tee setter 122 is positioned at the desired location on the ground with a radially disposed support surface 134 in contact with the ground about the desired point of insertion of tee 132. The user would then apply a downward pressure using his or here foot to cap 128 to push plunger 126 downward relative to base 124 and tee 132 into the ground at the desired location of placement, see change from FIG. 18*a* to FIG. 18*b*. Following this step the entire assembly would be tipped slightly to break the bond between tee 132 and adhesive material 130 while tee 132 is held in place by the ground. Then the user would lift the entire assembly to expose tee 132 installed to the desired depth in the ground.

If desired it is possible to provide adjustment means to permit user selection of a depth of penetration of the tee into the ground. This is easily accomplished by providing adjustment to the relative placement of adhesive material 130 relative to radially disposed support surface 134 when plunger 126 is fully extended downward relative to base 124. This adjustment may be either to the range of motion of plunger 126 relative to base 124 or in the placement of adhesive material 130 on plunger 126.

Figure 21:
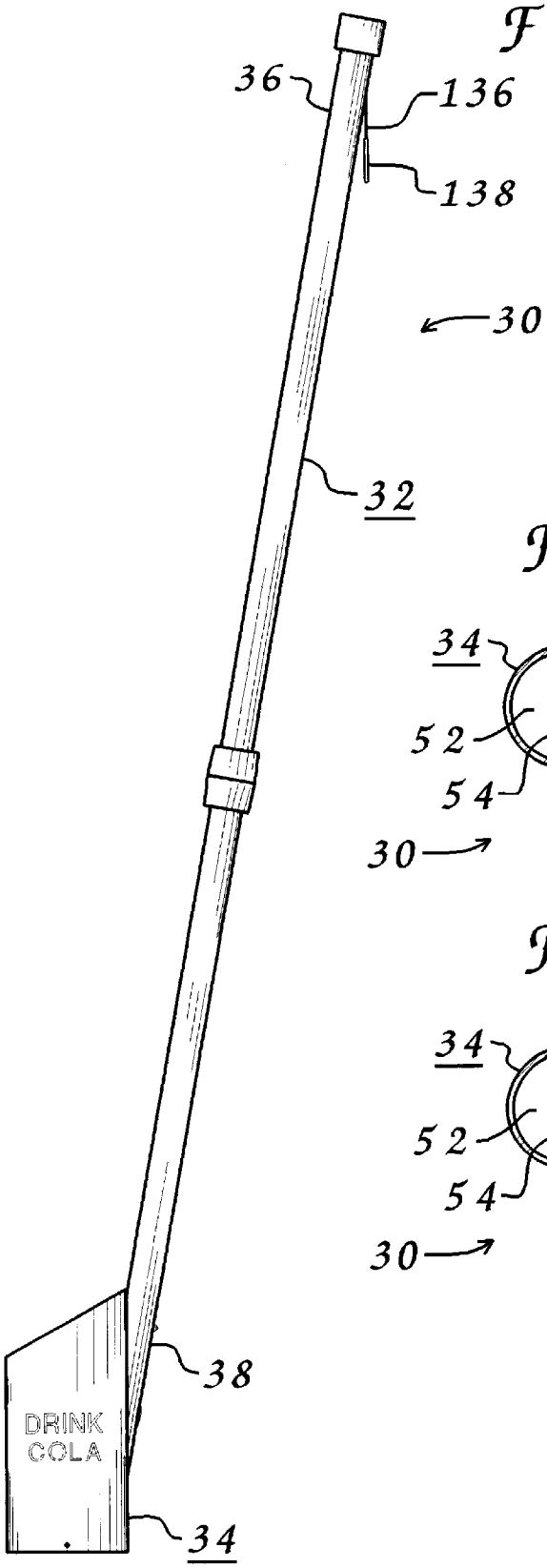
FIG. 21 is a side elevational view of a golf ball retrieval and pick up device with a control device installed thereon.
Figure 22A:
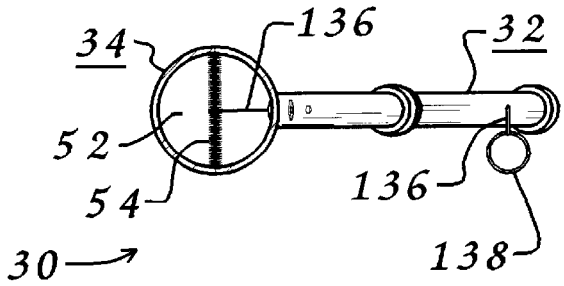
FIG. 22*a* and FIG. 22*b* are bottom plan views of the golf ball retrieval and pick up device shown in FIG. 21 with the control device in alternating operational orientations.
Figure 22B:
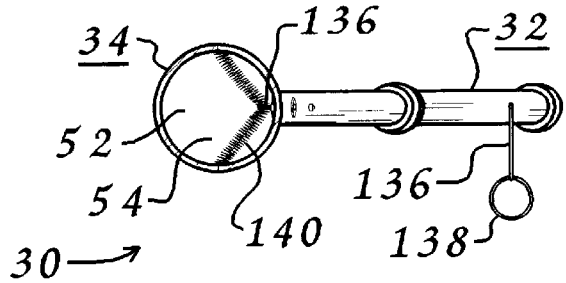
Figure 23A:
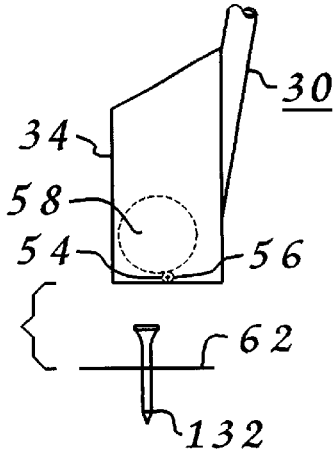
FIG. 23*a* through FIG. 23*d* are side elevational views of portions of the golf ball retrieval and pick up device and portions of the control device as shown in FIG. 21 and in various operational orientation while placing a golf ball on a tee.
Figure 23B:
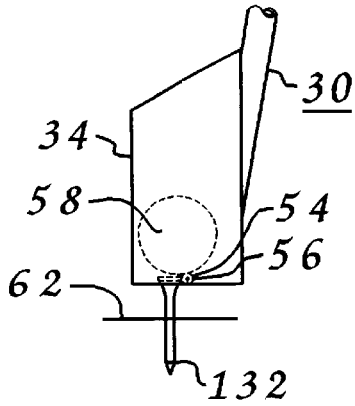
Figure 23C:
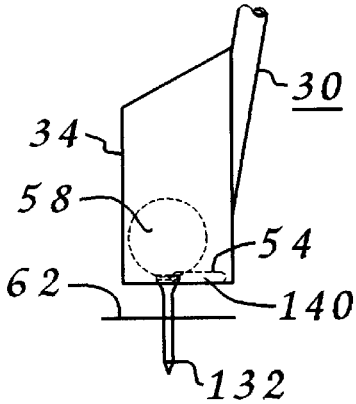
Figure 23D:
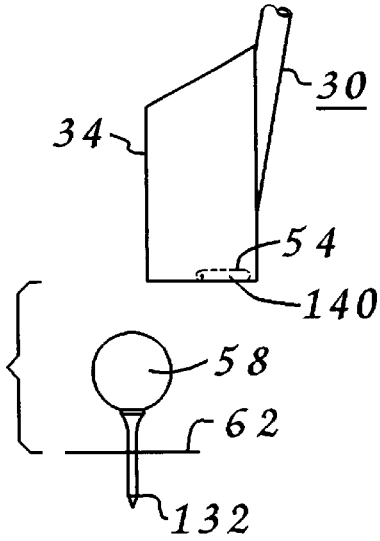
Figure 24A:
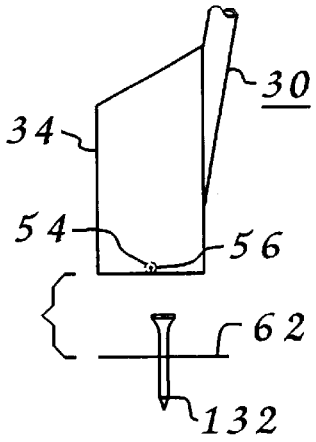
FIG. 24*a* through FIG. 24*d* are side elevational views of portions of the golf ball retrieval and pick up device and portions of the control device as shown in FIG. 21 and in various operational orientation while picking up a tee.
Figure 24B:
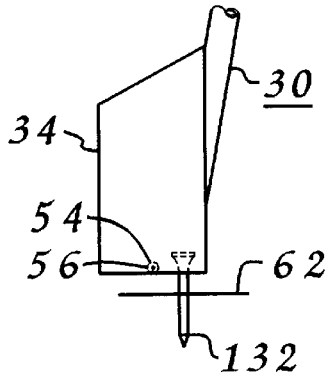
Figure 24C:
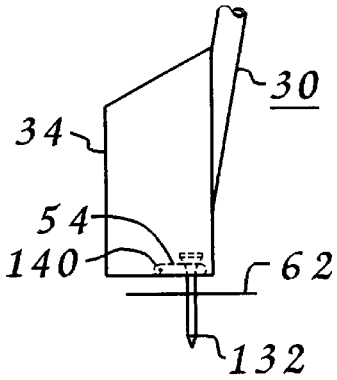
Figure 24D:
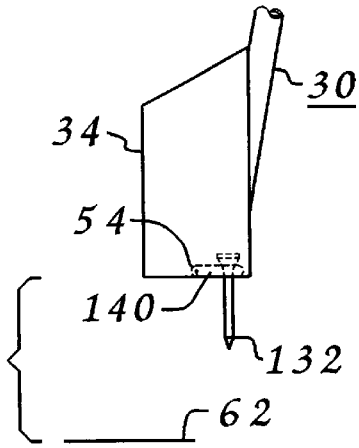

FIG. 21, FIG. 22*a* and FIG. 22*b* depict an arrangement wherein the user may remotely manipulate placement of tension member 54 relative to first opening 48 of tubular housing 34. A draw cable 136 is contained within elongated handle 32 and extends out of elongated handle 32 at gripping end 36 and at distal end 38. Draw cable 136 has a control ring 138 attached to gripping end 36 and attaches to tension member 54 at distal end 38. When the user draws on control ring 138, tension member 54 is displaced relative to first opening 48 of tubular housing 34. This control of tension member 54 may be utilized to allow release of a golf ball through first opening 48 or may be utilized to trap and grasp objects, such as tees. As conventionally known in the art it is possible to provide structures about control ring 138 which permit selective retention of draw cable 136, and therefore tension member 54, in a retracted position 140, see FIG. 22*b*. This arrangement would permit the user to manipulate golf ball pick up device 30 while tension member 54 remains in retracted position 140 without requiring the user to continue to have contact with control ring 138.

It is desirable to provide for structures to allow for the player to place a golf ball at a desired location on the ground or to place a golf ball on a tee inserted into the ground while the player remains upright during the entire placement procedure without requiring the player to bend over or squat down. Such structures must allow the player to position the golf ball relative to the device while manipulating the device and the golf ball at a convenient elevational level, must retain the golf ball during movement of the golf ball to an elevational level substantially at ground level and must allow for release of the golf ball onto the ground or onto the tee while the player remains erect during the entire placement procedure. Various configurations are possible to provide for these structures.

FIG. 23*a* through FIG. 23*d* depict a sequence of events which may be utilized to place golf ball 58 on tee 132 using golf ball pick up device 30. It being understood that golf ball pick up device 30 shown in FIG. 23*a* through FIG. 23*d* has the control structures as depicted in FIG. 21, FIG. 22*a* and FIG. 22*b* installed thereon to allow for the user to remotely manipulate tension member 54. Tee 132 has previously been installed into ground 62 utilizing any installation method including use of the tee setter device of the present invention. Golf ball 58 is positioned in tubular housing 34 of golf ball pick up device 30 while tension member remains in static position 56. The user then manipulates golf ball pick up device 30 to place tubular housing 34 generally over tee 132, see FIG. 23*a*. Then the user continues to manipulate golf ball pick up device 30 to place golf ball 58 on tee 132 using visual sightings including those available through tubular housing 34, see FIG. 23*b*. Then the user manipulates the control device to displace tension member 54 within tubular housing 34, see FIG. 23*c*, to retracted position 140. Then, with tension member 54 still displaced to retracted position 140 within tubular housing 34, the user lifts golf ball pick up device 30 up and off of golf ball 58 which remains positioned on tee 132, see FIG. 23*d*. If during any of these procedures golf ball 58 falls off of tee 132 the user simply releases the control device to allow tension member 54 to return to static position 56 and uses golf ball pick up device 30 to pick up golf ball 58 from ground 62 and repeats the procedure.

It is desirable to provide for structures to allow for the player to pick up a tee while the tee is either inserted into the ground or where the tee is lying upon the ground while the player remains upright during the entire retrieval procedure without requiring the player to bend over or squat down. Such structures must allow the player to manipulate the device to engage the tee and must retain the tee until conveyed to an elevated position for subsequent controlled release. Various configurations are possible to provide for these structures.

FIG. 24*a* through FIG. 24*d* depict a sequence of events which may be utilized to retrieve tee 132 from ground 62 using golf ball pick up device 30. It being understood that golf ball pick up device 30 shown in FIG. 24*a* through FIG. 24*d* has the control structures as depicted in FIG. 21, FIG. 22*a* and FIG. 22*b* installed thereon to allow for the user to remotely manipulate tension member 54. While tee 132 is depicted standing in ground 62 the following procedure may also be utilized with minor modification to retrieve tee 132 from a resting position on ground 62. The user manipulates golf ball pick up device 30 to place tubular housing 34 over tee 132, see FIG. 24*a*, while tension member 54 remains in static position 56. Then the user continues to manipulate golf ball pick up device 30 to place tubular housing 34 over tee 132 with tee 132 behind tension member 54, see FIG. 24*b*. The user manipulates the control device to displace tension member 54 within tubular housing 34, see FIG. 24*c*, to retracted position 140. This operation then traps tee 132 between tension member 54 and tubular housing 34. Then the user lifts golf ball pick up device 30 to remove tee 132 from ground 62, see FIG. 24*d*. Preferably, the control device to manipulate tension member 54 has the previously disclosed means to retain tension member 54 in retracted position 140 without requiring the user to physically hold any part of the control device. Then the user would elevate golf ball pick up device 30 and retrieve tee 132 at a convenient elevational level.

It is desirable to provide for structures to allow for the player to place a marker on the ground indicative of a position of a golf ball on the ground while the player remains upright during the entire marker placement procedure and to retrieve the marker from the ground while the player remains upright during the entire marker retrieval procedure without requiring the player to bend over or squat down during either the placement or retrieval procedures. Such structures must allow the player to position the ball marker relative to a golf ball resting on the ground without disturbing the position of the golf ball, must allow the player to release the ball marker from the device and must allow the player to retrieve the ball marker while the player remains erect during the entire ball marking procedure. Various configurations are possible to provide for these structures.

Figure 19:
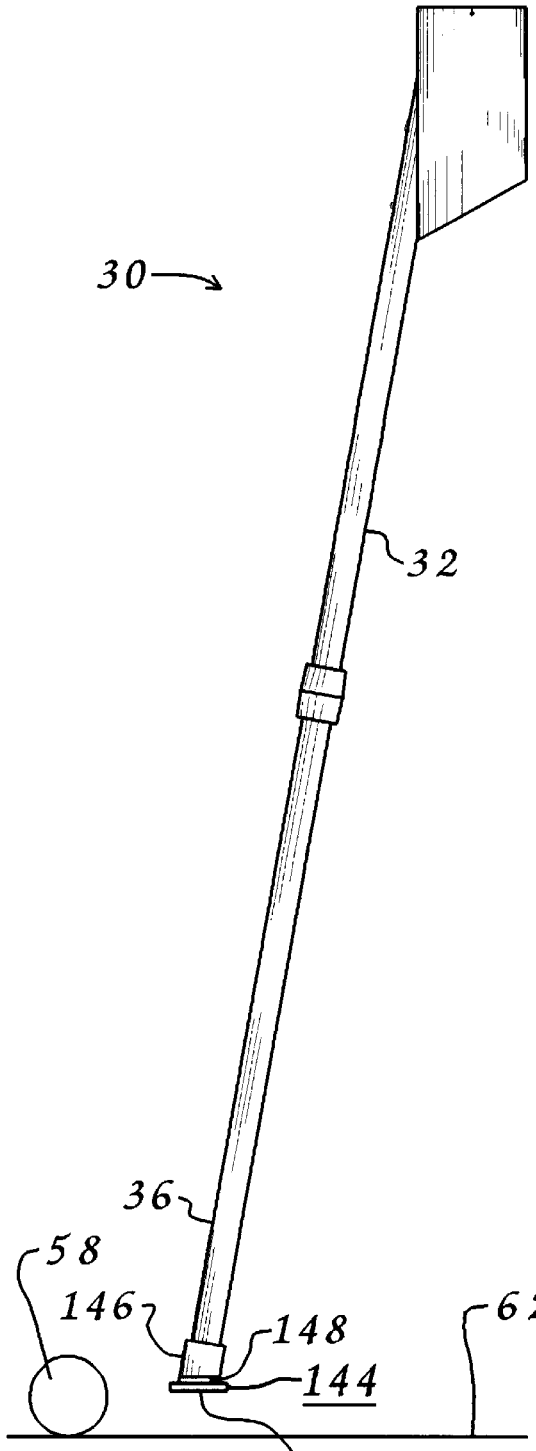
FIG. 19 is a side elevational view of a golf ball retrieval and pick up device with a marker placement and retrieval device attached thereto and positioned in close proximity to a golf ball resting on the ground.
Figure 20A:
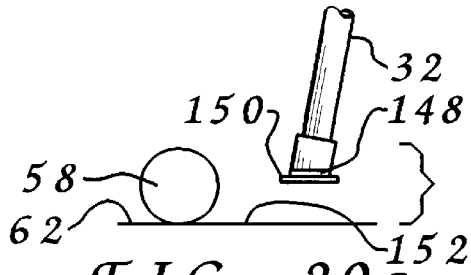
FIG. 20*a* through FIG. 20*e* are side elevational views of the marker placement and retrieval device and a portion of the golf ball retrieval and pick up device shown in FIG. 19 and in various operational orientations relative to a marker.
Figure 20B:
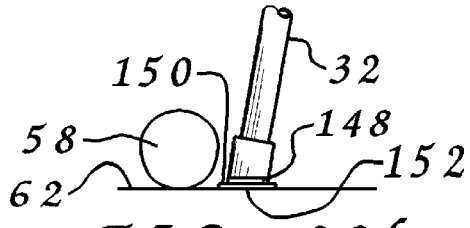
Figure 20C:
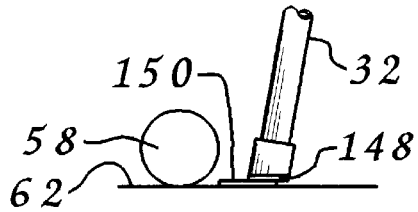
Figure 20D:
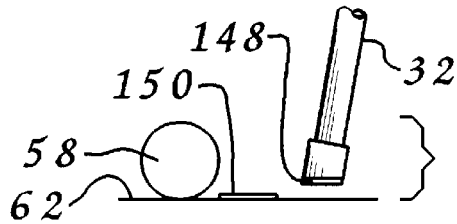
Figure 20E:
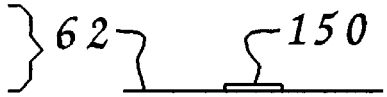

FIG. 19 depicts golf ball pick up device 30 having a ball marker assembly 144 attached thereto. In this embodiment ball marker assembly is installed on elongated handle 32 at the end of gripping end 36. Ball marker assembly 144 has a cap 146, a magnetic member 148 and a detachable marker 150. Detachable marker 150 is, at least partially, formed of a metal which is attractable by magnetic member 148. Preferably, magnetic member 148 is angularly offset relative to the longitudinal length of elongated handle 32 to provide for convenient use by the user. The normal sequence of marking a locational position of a golf ball involves placing a marker on the ground adjacent the golf ball away from the hole, picking up the golf ball from the resting place, allowing other golfing procedures to occur, placing the golf ball back on the ground as close as possible to the original resting place and picking up the marker.

FIG. 20*a* through FIG. 20*e* depict the steps involved with marking the location and removing the golf ball. First, the user would place detachable marker 150 on magnetic member 148 and manipulate golf ball pick up device 30 to place detachable marker 150 in close proximity to golf ball 58 resting on ground 62, see FIG. 20*a*. Then, the user continues to manipulate golf ball pick up device 30 to position detachable marker 150 in contact with ground 62 at a desired marking position 152 adjacent golf ball 58, see FIG. 20*b*. Then the user manipulates golf ball pick up device 30 to begin to slide magnetic member 148 off of detachable marker 150 while maintaining a slight pressure between detachable marker 150 and ground 62 wherein detachable marker remains fixed relative to ground 62, see FIG. 20*c*. To this end, it is preferred to have one side of detachable marker 150 have a texture thereon to enhance gripping properties. Then, the user continues to manipulate golf ball pick up device 30 to slide magnetic member 148 completely off of detachable marker 150, see FIG. 20*d*. Then, with the position of golf ball 58 marked, the user would remove golf ball 58 from ground 62 using any desired method including use of golf ball pick up device 30. If during the previously disclosed procedure detachable marker 150 is positioned in an unacceptable position prior to removal of golf ball 58 the user would retrieve detachable marker 150 using magnetic member 148 and repeat the procedure.

The completion of the ball marking procedure involves placing golf ball 58 adjacent detachable marker 150 in a position as close to the original resting place as possible. This may be accomplished using any desired method including use of the golf ball release method of the present invention. Following the placement of golf ball 58 the user would manipulate golf ball pick up device 30 to place magnetic member 148 in contact with detachable member 150 and remove detachable member 150 from ground 62.

As can readily be seen, it is possible utilizing the various features of the present invention for a golfer to participate in the play of golf without requiring the user to bend over or squat down. It is possible to provide for the user to retain in their hand either a club or the golf ball pick up device of the present invention during actual play and rest the remaining objects on the ground. Then, utilizing the object which they are holding, to manipulate the remaining objects from their respective resting positions to a vertical orientation where they may be gathered without requiring the user to bend over or squat down. Some players prefer to carry several clubs with them during their walking movements about the course. During these occasions it is possible to provide for a resting of the grips of the clubs not being used at any particular moment across a portion of the golf ball pick up device which is resting on the ground to prevent the grips of the clubs from coming into contact with either the ground or grass growing on the ground. This arrangement provides for the grips of the clubs to remain clean and dry.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf ball pick up device to pick up a golf ball from a ground surface and transfer the golf ball to an elevated location for subsequent release, the golf ball pick up device comprising:

a) an elongated handle having a gripping end and a distal end;

b) a tubular housing having a first opening, a second opening and a cavity positioned between the first opening and the second opening, the tubular housing attached to the distal end of the elongated handle with the first opening of the tubular housing positioned away from the gripping end of the elongated handle and the second opening of the tubular housing positioned toward the gripping end of the elongated handle and wherein the tubular housing at the first opening is flush and wherein the tubular housing at the second opening is angled wherein the tubular housing has a height distal from the elongated handle which is smaller than a height of the tubular housing adjacent the elongated handle;

c) tension means to provide for regulating passage of the golf ball through the first opening of the tubular housing, the tension means having a displacement resistance from a static position, the displacement resistance of the tension means insufficient to prevent passage thereby of the golf ball into the cavity of the tubular housing upward through the first opening of the tubular housing of the golf ball pick up device while the first opening of the tubular housing of the golf ball pick up device is positioned over the golf ball while the golf ball rests on the ground surface and a downward pressure is applied to the golf ball pick up device, the displacement resistance of the tension means sufficient to prevent passage thereby of the golf ball from the cavity of the tubular housing downward through the first opening of the tubular housing of the golf ball pick up device while the golf ball is positioned within the cavity of the tubular housing.

2. The golf ball pick up device defined in claim 1 wherein the tension means further comprises a tension member positioned across the first opening of the tubular housing.

3. The golf ball pick up device defined in claim 1 wherein the elongated handle further comprises at least a first section and a second section and wherein the sections of the elongated handle have a usage orientation and a transport orientation, the usage orientation to provide for a use of the golf ball pick up device to pick up the golf ball from the ground surface and transfer the golf ball to the elevated location, the usage orientation having an overall length of the golf ball pick up device when the sections are placed adjacent each other, the transport orientation to provide for a significant reduction in an overall length of the golf ball pick up device from the overall length of the golf ball pick up device while in the usage orientation to provide for a ready transport of the golf ball pick up device.

4. The golf ball pick up device defined in claim 3 wherein the sections of the elongated handle are detached while in the transport orientation.

5. The golf ball pick up device defined in claim 1 wherein the tension member is a coil spring.

6. The golf ball pick up device defined in claim 1 wherein the cavity of the tubular housing further has an interior length and wherein the interior length of the cavity of the tubular housing is of a measurement sufficient to readily contain two golf balls within the cavity of the tubular housing.

7. A golf ball pick up device to pick up a golf ball from a ground surface and transfer the golf ball to an elevated location for subsequent release, the golf ball pick up device comprising:

a) an elongated handle having a gripping end and a distal end;

b) a tubular housing having a first opening, a second opening and a cavity positioned between the first opening and the second opening, the tubular housing attached to the distal end of the elongated handle with the first opening of the tubular housing positioned away from the gripping end of the elongated handle and the second opening of the tubular housing positioned toward the gripping end of the elongated handle;

c) tension means to provide for regulating passage of the golf ball through the first opening of the tubular housing, the tension means having a displacement resistance from a static position, the displacement resistance of the tension means insufficient to prevent passage thereby of the golf ball into the cavity of the tubular housing upward through the first opening of the tubular housing of the golf ball pick up device while the first opening of the tubular housing of the golf ball pick up device is positioned over the golf ball while the golf ball rests on the ground surface and a downward pressure is applied to the golf ball pick up device, the displacement resistance of the tension means sufficient to prevent passage thereby of the golf ball from the cavity of the tubular housing downward through the first opening of the tubular housing of the golf ball pick up device while the golf ball is positioned within the cavity of the tubular housing;

d) means to manipulate the tension member to release a golf ball contained in the cavity of the tubular housing onto a tee inserted into the ground.

8. A golf ball manipulation device to manipulate a golf ball, the golf ball manipulation device comprising:

a) a handle to provide for a manipulation of the golf ball manipulation device, the handle elongated and having a gripping end and a distal end;

b) a tubular housing having a first opening, a second opening and a cavity positioned between the first opening and the second opening, the tubular housing attached to the distal end of the handle at an angle of offset with the first opening of the tubular housing positioned away from the gripping end of the handle and the second opening of the tubular housing positioned toward the gripping end of the handle;

c) a tension member positioned across the first opening of the tubular housing, the tension member having a displacement resistance from a static position, the displacement resistance of the tension member insufficient to prevent passage thereby of the golf ball into the cavity of the tubular housing through the first opening of the tubular housing of the golf ball pick up device while the first opening of the tubular housing of the golf ball pick up device is positioned over the golf ball while the golf ball rests on the ground surface and a downward pressure is applied to the golf ball pick up device, the displacement resistance of the tension member sufficient to prevent passage thereby of the golf ball from the cavity of the tubular housing through the first opening of the tubular housing of the golf ball pick up device while the golf ball is positioned within the cavity of the tubular housing;

d) tension member manipulation means to provide for a manipulation of the tension member to release a golf ball contained in the cavity of the tubular housing onto a tee inserted into the ground.

9. A golf ball manipulation device to manipulate a golf ball, the golf ball manipulation device comprising:

a) a handle to provide for a manipulation of the golf ball manipulation device, the handle elongated and having a gripping end and a distal end;

b) a tubular housing having a first opening, a second opening and a cavity positioned between the first opening and the second opening, the tubular housing attached to the distal end of the handle at an angle of offset with the first opening of the tubular housing positioned away from the gripping end of the handle and the second opening of the tubular housing positioned toward the gripping end of the handle;

c) a tension member positioned across the first opening of the tubular housing, the tension member having a displacement resistance from a static position, the displacement resistance of the tension member insufficient to prevent passage thereby of the golf ball into the cavity of the tubular housing through the first opening of the tubular housing of the golf ball pick up device while the first opening of the tubular housing of the golf ball pick up device is positioned over the golf ball while the golf ball rests on the around surface and a downward pressure is applied to the golf ball pick up device, the displacement resistance of the tension member sufficient to prevent passage thereby of the golf ball from the cavity of the tubular housing through the first opening of the tubular housing of the golf ball pick up device while the golf ball is positioned within the cavity of the tubular housing;

d) tension member manipulation means to provide for a manipulation of the tension member to engage a tee from ground level for subsequent transfer to an elevated position.

* * * * *